US006975934B2

(12) United States Patent
Ishikawa et al.

(10) Patent No.: US 6,975,934 B2
(45) Date of Patent: Dec. 13, 2005

(54) CONTROL SYSTEM FOR CORRECTING A TORQUE VARIATION OF AN ENGINE

(75) Inventors: Yosuke Ishikawa, Saitama (JP); Yoshihisa Iwaki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 28 days.

(21) Appl. No.: 10/801,585

(22) Filed: Mar. 17, 2004

(65) Prior Publication Data

US 2004/0193360 A1 Sep. 30, 2004

(30) Foreign Application Priority Data

Mar. 27, 2003 (JP) ..... 2003-088737

(51) Int. Cl.[7] ..... G06G 7/70

(52) U.S. Cl. ..... 701/111; 701/110; 701/115; 123/406.24; 123/406.23; 123/436; 123/478; 123/480; 123/486

(58) Field of Search ..... 701/110, 111, 115; 123/406.23, 406.24, 436, 478, 480, 486

(56) References Cited

U.S. PATENT DOCUMENTS 5,947,087 A * 9/1999 Minowa et al. ..... 123/399

FOREIGN PATENT DOCUMENTS

JP 2867747 12/1998

* cited by examiner

*Primary Examiner*—Tony M. Argenbright
*Assistant Examiner*—Johnny H. Hoang
(74) *Attorney, Agent, or Firm*—Squire, Sanders & Dempsey LLP

(57) ABSTRACT

The present invention provides a control system for an internal combustion engine for detecting a torque variation based on a rotational speed of the engine and suppress the torque variation. The system includes a detector for detecting a rotational speed of the engine, a memory for storing a variation pattern of the rotational speed of the engine when a torque of the internal combustion engine is excessive and a controller for calculating a variation component of the rotational speed based on the detected rotational speed, The controller calculates the correlation between the variation component and the variation pattern that is read out from the memory and then determines a torque variation state of the engine based on the correlation.

29 Claims, 8 Drawing Sheets

CONTROL SYSTEM FOR CORRECTING A TORQUE VARIATION OF AN ENGINE

BACKGROUND OF THE INVENTION

The present invention relates to a control system for correcting torque variation in an internal combustion engine.

Conventionally, as a process for improving a catalyst purification rate, an air-fuel ratio (A/F) is intermittently switched between lean and rich during a warming-up stage at a cold-start time of an internal combustion engine to cause fire at the catalyst in order to raise the temperature of the catalyst. Such switching-over between lean and rich may cause torque variation that is synchronized with a switching cycle.

Besides, regardless of the presence or absence of such switching-over of the air-fuel ratio, there occurs a vibration having a certain cycle in the engine rotational speed due to a torque variation of each cylinder caused by deterioration over time or the like.

Since these variations are not desirable from a drivability viewpoint, there are some known techniques for offsetting the torque variation by changing a retard amount for an ignition timing in accordance with a value of the air-fuel ratio (refer to the Japanese Patent No. 2867747).

However, the magnitude of torque variation may vary in accordance with operational conditions and/or individual properties of the internal combustion engines. Besides, there exists such torque variation that is not dependent on the switching-over of the air-fuel ratio. Accordingly, in some cases, it is not possible to control the torque variation according to the conventional approaches.

Thus, there is a need for a technique for precisely detecting the state of an excessive torque variation.

SUMMARY OF THE INVENTION

The present invention provides a control system for an internal combustion engine for detecting an excessive torque variation based on rotational speeds of the internal combustion engine to suppress the torque variation.

According to one aspect of the present invention, the control system includes a detector for detecting a rotational speed of an internal combustion engine, and a memory for storing a variation pattern of the rotational speed of the internal combustion engine when a torque of the internal combustion engine is excessive. The system includes a controller configured to calculate variation component of the rotational speed based on the rotational speed detected by the detector, and to calculate the correlation between the variation component and the variation pattern that is read out from the memory. The controller is configured to determine the torque variation state of the internal combustion engine based on the calculated correlation.

According to this aspect of the invention, it is possible to detect a magnitude of the torque variation in real time by using the correlation between the variation in the rotational speed of the internal combustion engine and the variation pattern that is pre-stored as a typical example for the case where the torque variation in a given period is excessive.

The controller may be configured to correct the ignition timing of the internal combustion engine based on the determination result regarding the torque variation state, so that the detected torque variation can be suppressed. Alternatively, the controller be configured to correct the intake air amount of the internal combustion engine based on the determination result regarding the torque variation state.

The variation components are determined from the differences between the rotational speed and the average of the rotational speed. It is preferable that the normalized rotational speed is used. Thus, instead of using the value of the rotational speed, the same variation pattern can always be used without needing to prepare different variation patterns. Specifically, normalization process includes multiplying of the variance of the rotational speed (sum of the square of the differences between discrete rotational speeds and the average of the rotational speed) with a given period and taking a square root of the product.

The calculation of the correlation is performed by calculating an inner product of the variation component of the rotational speed and the variation pattern. When the correlation determined by the inner product calculation exceeds a predetermined upper limit value, the torque variation of the internal combustion is determined to be excessive. When the correlation is smaller than a predetermined lower limit value, the torque variation of the internal combustion is determined to be too small. Because the correlation between the variation component of the rotational speed and the variation pattern is determined by a numerical value through the inner product calculation, the magnitude of the torque variation can readily be determined.

Besides, the controller according to the present invention may further be configured to retard the ignition timing of the internal combustion engine when the torque variation of the internal combustion engine is determined to be excessive, and to advance the ignition timing when the torque variation of the internal combustion engine is determined to be too small. Thus, it is possible to reduce the detected torque variation regardless of differences among the individual internal combustion engines, operational conditions, differences among the cylinders and so on.

Alternatively, the controller may be configured to decrease the intake air amount of the internal combustion engine when the torque variation of the internal combustion engine is determined to be excessive, and to increase the intake air amount when the torque variation of the internal combustion engine is determined to be too small.

It is preferable that the torque variation state is determined when an air-fuel ratio is intermittently switched between lean and rich. It is more preferable that the torque variation state is determined when a catalyst warming-up control is performed upon a catalyst that is disposed on the downstream side of the internal combustion engine. Thus, it is possible to detect in real time the torque variation caused by the air-fuel ratio switching and to suppress the detected torque variation.

DESCRIPTION OF THE PREFERRED EMBODIMENTS

Preferred embodiments will now be described with reference to the accompanying drawings.

Figure 1:
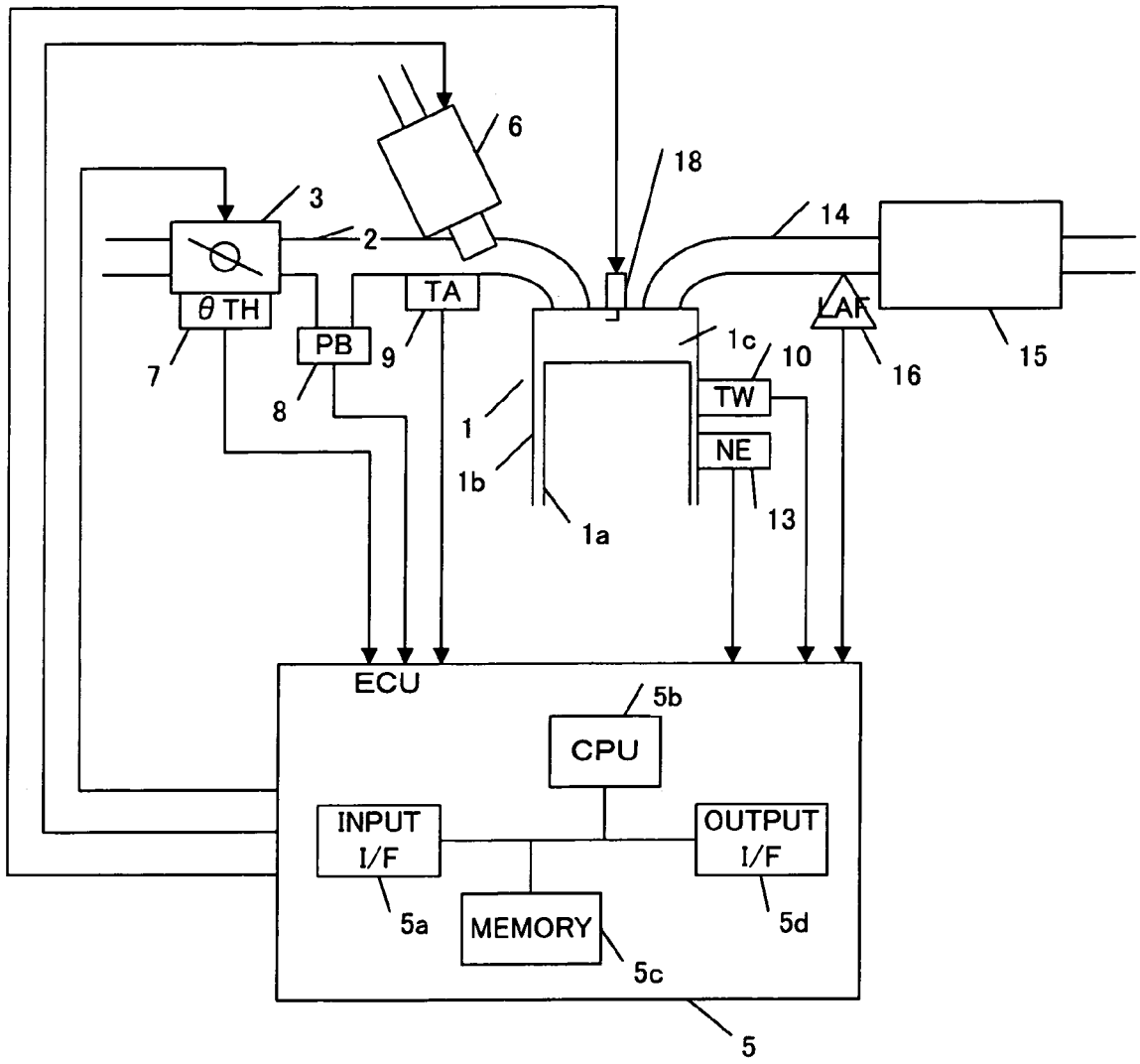
FIG. 1 is a block diagram of an internal combustion engine in which a control system according to the present invention is applied.

FIG. 1 is a block diagram of an internal combustion engine having a torque-variation controlling system in accordance with one embodiment of the present invention. An internal combustion engine (hereinafter referred to as an "engine") 1 is a 4-cylinder, 4-stroke type engine having cylinders 1*a* and pistons 1*b* (only one cylinder is shown in FIG. 1). A combustion chamber 1*c* is formed between a piston and a cylinder head. A spark plug 18 is attached in the combustion chamber 1*c*. A fuel injection valve 6 is, for each cylinder, provided in an air intake pipe 2 of the engine 1. Each fuel injection valve 6 is connected to a fuel pump (not shown) to inject fuel under a control of an electronic control unit (hereinafter referred to as an "ECU) 5. When the fuel is injected from the fuel injection valve 6, air-fuel mixture is supplied to the combustion chamber 1*c* of each cylinder of the engine 1, so that the mixture is burned in the combustion chamber 1*c* and the exhaust gas is discharged into an exhaust pipe 14.

A throttle valve 3 is disposed in a passage of the air intake pipe 2 to adjust the flow amount of the air passing through the air intake pipe. The throttle valve 3 is connected to an actuator (not shown) for controlling an throttle valve opening degree θTH. The actuator is electrically connected to the ECU 5 to change the throttle valve opening degree θTH, to change the intake air amount in accordance with a signal from the ECU 5. An intake air pressure sensor 8 and an intake air temperature sensor 9 are disposed downstream of the throttle valve 3 of the air intake pipe 2 to detect an air-intake-pipe internal pressure PB and an intake air temperature TA respectively. Signals of the pressure PB and the temperature TA are sent to the ECU 5.

A crank angle sensor is attached to a crankshaft (not shown) of the engine 1. The crank angle sensor outputs a CR signal, for example, for every 30 degrees of rotation of the crankshaft. A rotational speed sensor 13 detects an engine rotational speed NE based on the pulse period of the CR signal from the crank angle sensor and sends the NE signal to the ECU 5. Additionally, a TDC sensor may be attached to the crankshaft or a camshaft to output TDC signals every 90 degrees at piston top dead centers of the cylinders. The TDC signal is a pulse signal that is generated in a predetermined timing at the top dead center near an intake stroke starting time of each cylinder. In one embodiment, TDC pulses generated every 180 degree rotation of the crankshaft are used so that eight TDC pulses correspond to two rounds of the crankshaft, which correspond to 4-stroke of the piston movement. A water temperature sensor 10 is attached to the body of the engine 1 to detect a cooling water temperature TW of the engine and sends a signal indicating the detected temperature to the ECU 5.

The exhaust gas passes through the exhaust pipe 14 and then flows into an exhaust gas purification device 15. The exhaust gas purification device 15 includes a NOx adsorption catalyst (LNC) and/or the like. An air-fuel ratio sensor (hereinafter referred to as a "LAF sensor") 16 is disposed upstream of the exhaust gas purification device 15 to generate an output in a level that is in proportion to a wide range of the exhaust air-fuel ratio. The output is sent to the ECU 5.

The ECU 5 is structured with a microcomputer having an input interface 5*a* for processing input signals from various sensors, a CPU 5*b* for performing various control programs, a memory 5*c* including a RAM for temporarily storing programs and data required at a run time and providing a working space for calculations and a ROM for storing programs and data and an output interface 5*d* for sending control signals to each section. The signal from each sensor is input to the CPU 5*b* after A/D conversion and/or appropriate formation in the input interface 5*a*.

A fuel supply amount to the engine 1 is determined by controlling a fuel injection time TOUT of the fuel injection valve 6 by a driving signal from the ECU 5. Besides, the combustion of the air-fuel mixture in the combustion chamber is performed by igniting the spark plug 18 in accordance with the driving signal from the ECU 5. This ignition timing is corrected by adding an ignition timing correction value (which will be described later) to a basic ignition timing IGLOGP to be obtained by looking up a map based on the engine rotational speed NE and/or the intake air amount PB. Through such correction, the ignition timing is retarded or advanced within a given range.

Now, a catalyst warming-up control will be described. The temperature of the exhaust gas purification device 15 is low at a cold-start time of the engine. Therefore, in order to make the catalyst active, the air-fuel ratio is intermittently switched between lean and rich in a given cycle, so that plenty of oxygen is supplied during a lean phase while plenty of fuel is supplied during a rich phase. As a result, fire takes place within the exhaust gas purification device, whereby the catalyst warming-up control for raising the catalyst temperature is carried out.

However, such control may cause a variation in an engine torque in synchronization with the switching cycle of lean and rich, resulting in a problem of a deterioration of drivability. Therefore, it is required to suppress the torque variation in particular when the torque variation is excessive.

In one embodiment of the present invention, instead of directly calculating a torque, an excessive state of a torque variation due to switching of an air-fuel ratio is detected by calculating an inner product of a normalized engine rotational speed component and an engine rotational speed variation pattern when the torque is excessive in a given period. The principle for this method will now be described.

In general, an inner product of vectors A and B is expressed as can be seen in equation (1).

$$A \cdot B = a(1)b(1) + a(2)b(2) + \ldots + a(n)b(n) = |A||B|\cos\theta \quad (1)$$

In the equation (1), A and B are time-series vectors each including discrete n elements as shown in equation (2).

$$A = [a(1), a(2), \ldots, a(n)]$$
$$B = [b(1), b(2), \ldots, b(n)]^T \quad (2)$$

The term "cos θ" is the correlation factor of vectors A and B. When norms |A|=|B|=1, the correlation factor equals the inner product A·B. Accordingly, the correlation of the two vectors can be determined by the inner product of the two vectors.

Figure 2:
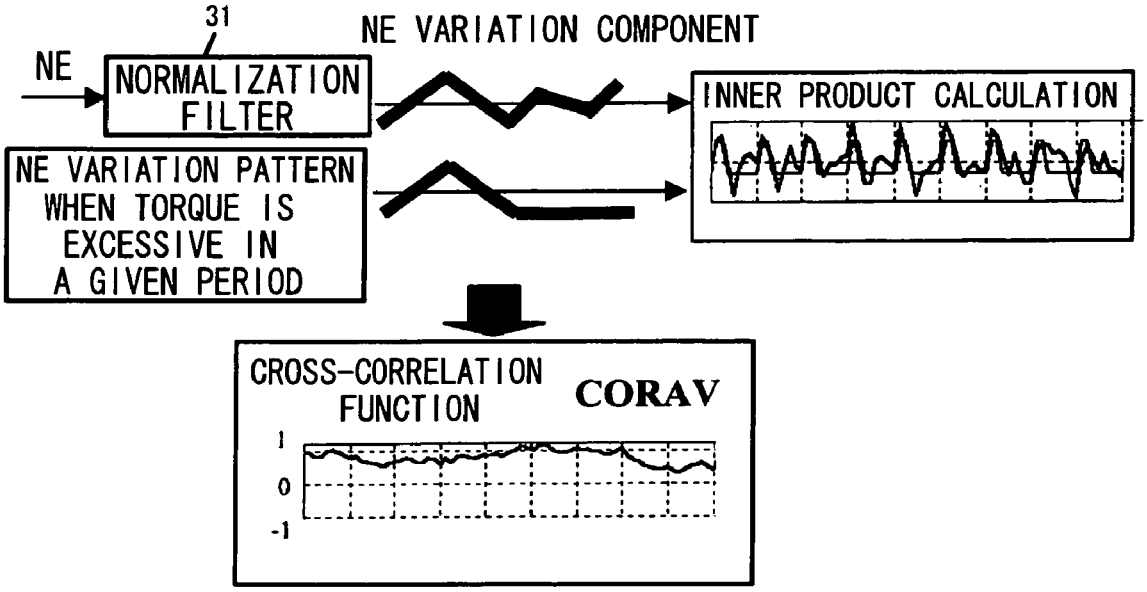
FIG. 2 shows an outline of a torque variation detection according to an inner product calculation.

FIG. 2 illustrates the concept of a torque variation detection according to the above-described method. First, a normalization filter 31 is used to produce a normalized NE variation component with the norm of 1. Differences between a moving average value of the engine rotational speed and instantaneous discrete values of the engine rotational speed (NE) are produced, which in turn are divided by a square root of the product of the variance (i.e., standard variance) over a given period. On the other hand, a normalized NE variation pattern of engine rotational speed under the condition that the torque is excessive in a given period is predetermined and stored in advance. A cross-correlation CORAV is calculated by taking an inner product of the normalized NE variation component and the variation pattern.

When CORAV is equal to or more than a positive threshold CORH, it is determined that the torque in the given period is excessive, so that the ignition timing of the engine is retarded. In contrast, when CORAV is equal to or less than a negative threshold CORL, it is determined that the torque in the given period is too small, so that the ignition timing is advanced. This way, torque variation can be suppressed.

Now, a process for detecting a torque variation in accordance of one embodiment of the present invention will be described.

Figure 3:
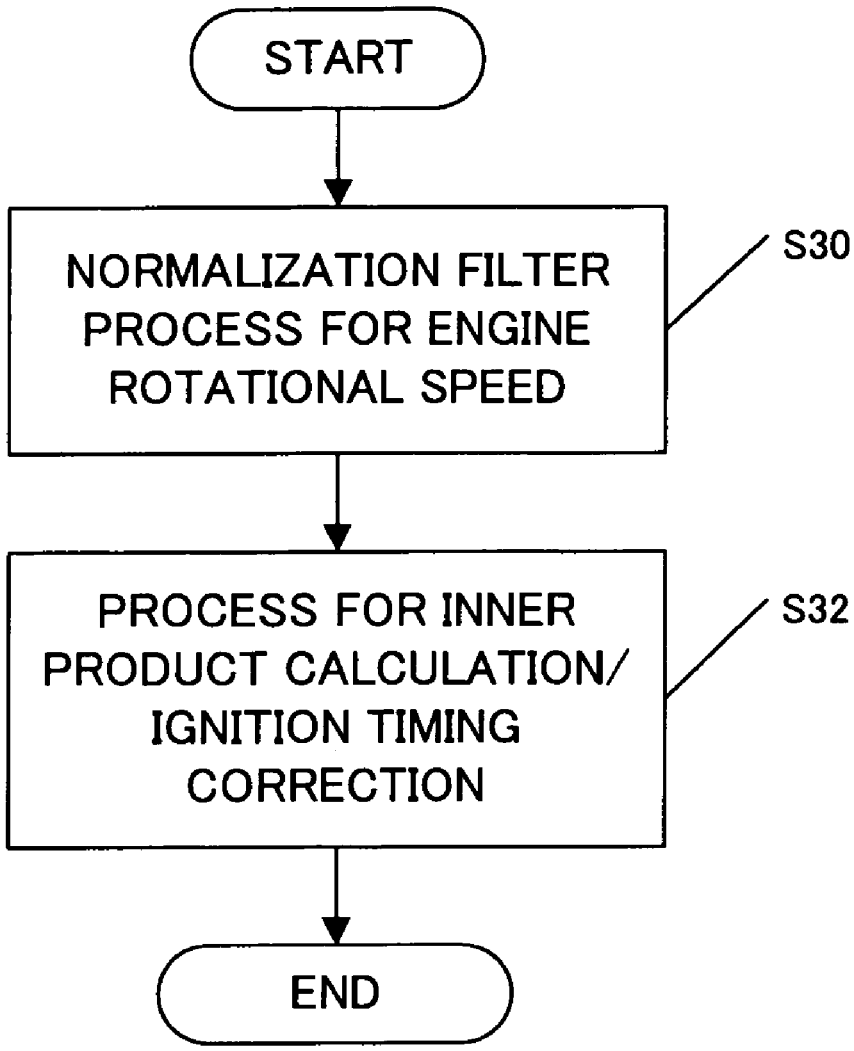
FIG. 3 is a main routine of a torque variation detection.

FIG. 3 illustrates a main routine of a torque variation detection logic. The detection of the torque variation is performed through two stages of a normalization filter process for the engine rotational speeds (S30) and an inner product operation/ignition-timing correction process (S32). The normalization filter process will be first described.

Figure 4:
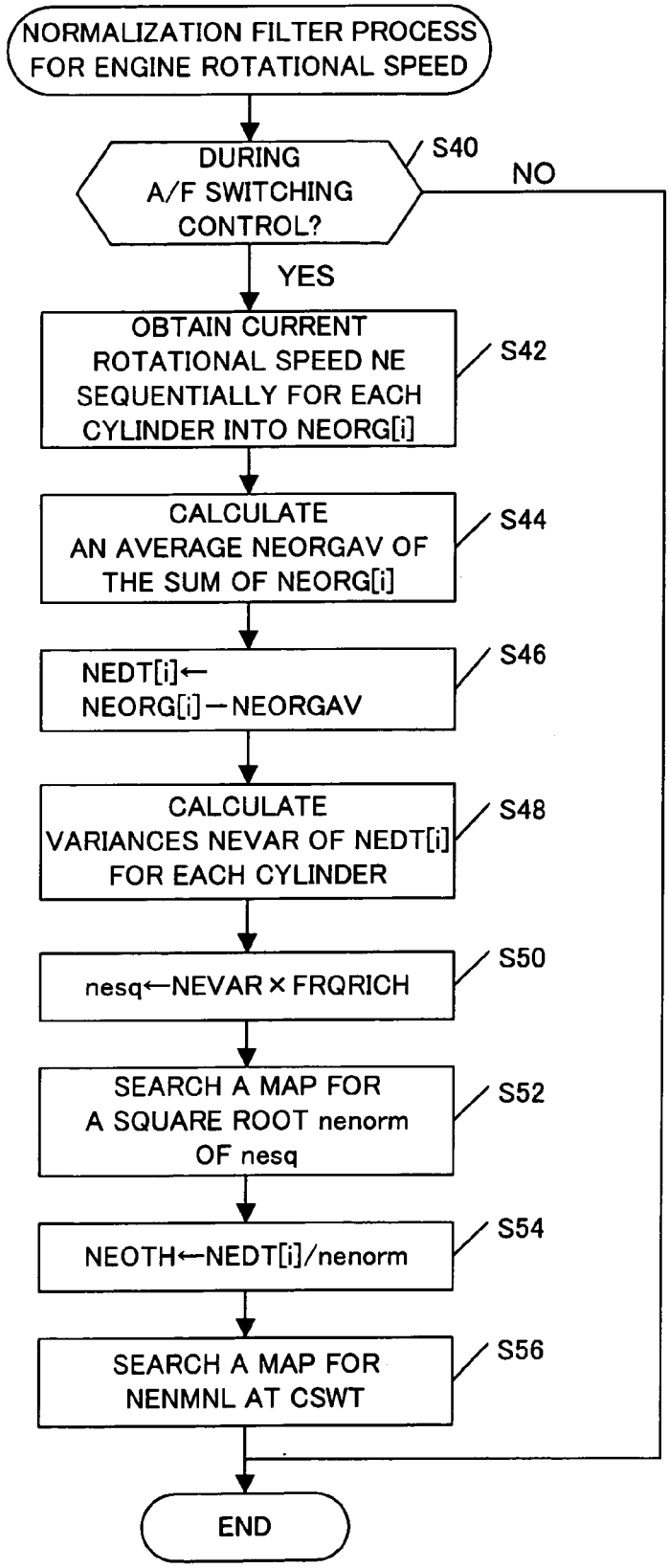
FIG. 4 is a routine of a normalization process for the engine rotational speeds.

FIG. 4 illustrates a routine of the normalization process for the engine rotational speeds. The vibration components of the engine rotational speeds NE is normalized to a vector having an norm of 1 for use in a later process of calculating the inner product.

First, whether or not the air-fuel ratio changeover control is being performed is determined (S40). When the air-fuel ratio changeover control is not being performed, the process terminates here without any operation. Otherwise, the process proceeds on.

In order to calculate a one cycle moving average of the engine rotational speed NE, engine rotational speed values NEORG[i] are stored in the buffers having the same number of stages as the number of cylinders Each buffer stage receives one NE sample value during one round of the crankshaft corresponding to four TDC pulses. (S42). The suffix "i" ranges from 0 to (the number of cylinders NOFCYL −1). Next, the moving average NEORGAV is calculated by dividing the sum of these engine rotational speed sample values by the number of the cylinders NOFCYL (S44). Then, a trend-removed value NEDT[i] or the difference from the average is calculated for each cylinder by subtracting the average value NEORGAV from the engine rotational speed value NEORG[i] (S46). These operations can be expressed as in the following equation (3).

$$NEORGAV = \sum_{i=0}^{NOFCYL-1} \frac{NEORG[i]}{NOFCYL} \tag{3}$$

$$NEDT[i] = NEORG[i] - NEORGAV$$

The dimension of the NE variation component vector for use with the inner product calculation corresponds to the period of detecting the torque variation. For example, when the air-fuel ratio switching control is performed in every eight TDCs and NE sampling is done at each TDC, the dimension of the NE variation component vector is eight. In order to normalize this vector, it is required to divide the NE variation component vector by its norm. For this purpose, in this embodiment, variance NEVAR of NEDT during one cycle is first calculated according to the following equation (4) (S48).

$$NEVAR = \sum_{i=0}^{NOFCYL-1} \frac{NEDT[i]^2}{NOFCYL} \tag{4}$$

Figure 5:
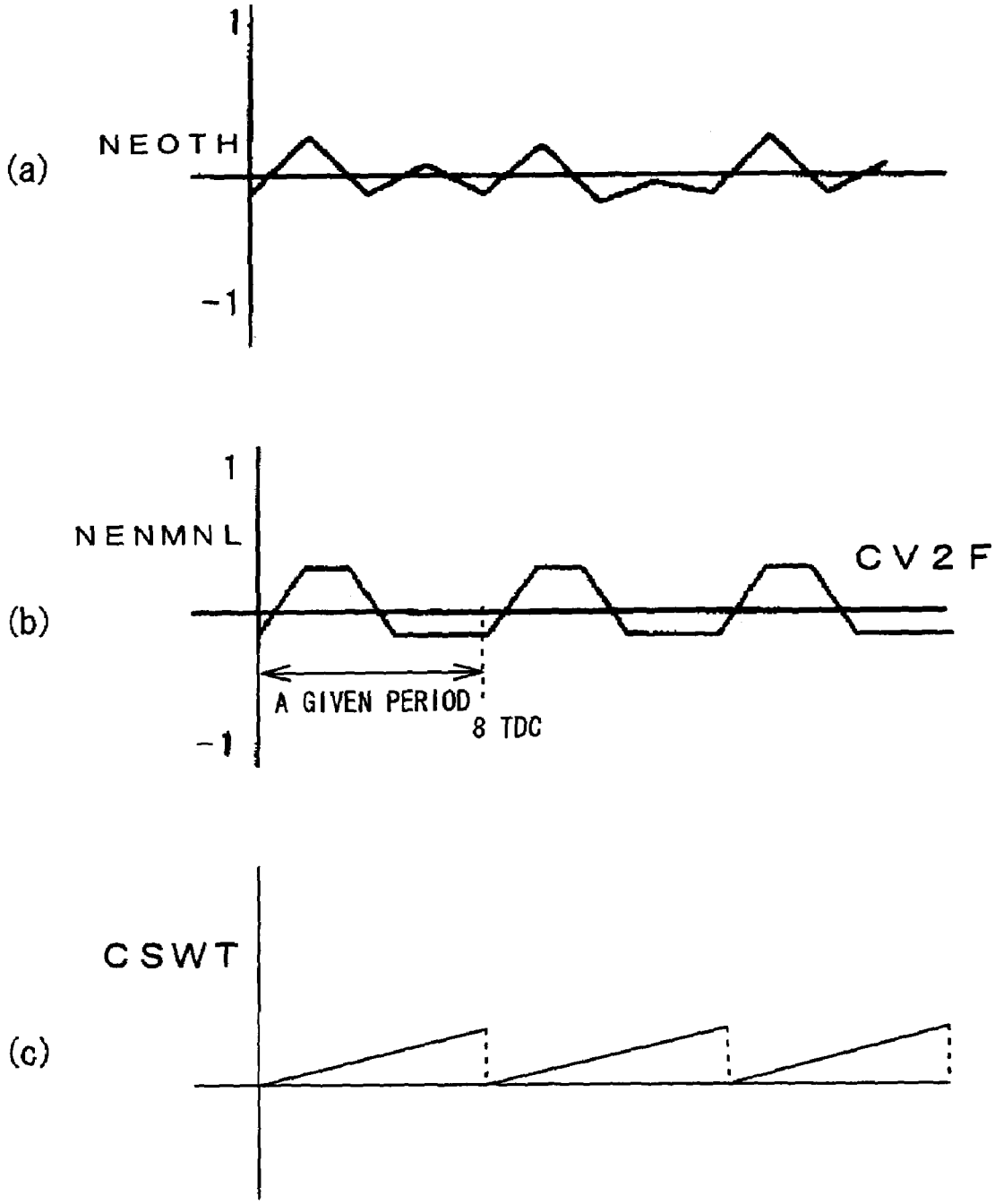
FIG. 5 shows (a) an example a normalized NE variation component NEOTH after the process of the routine in FIG. 4, (b) an example of a variation pattern NENMNL and (c) counts in a counter CSWT.

Then, variance NEVAR is multiplied by an air-fuel ratio changeover period FRQRICH (four, in this embodiment) to obtain a value nesq (S50), variance over the period of four TDCs. Next, a square root "nenorm" of the value "nesq" is obtained by looking up a map that is prepared in advance (S52). NEDT is divided by the value nenorm to obtain a normalized NE variation component NEOTH (S54). By repeating this calculation, a time-series vector of the NE variation component NEOTH is obtained. An example of NEOTH is shown in (a) of FIG. 5.

A predetermined NE variation pattern NENMNL under the conditions of excessive torque is obtained in the form of vectors for the corresponding given period. Specifically, the variation pattern vector is obtained using a counter CSWT ((c) of FIG. 5). The counter CSWT represents an elapse time from the start of the given period starts. It is reset to zero at the end of every period. The counter is incremented every time interval that corresponds to the given period divided by the number of elements in the vector. The variation pattern NENMNL as shown in (b) of FIG. 5 includes element values at corresponding time intervals to form the variation pattern vector (S56).

Figure 6:
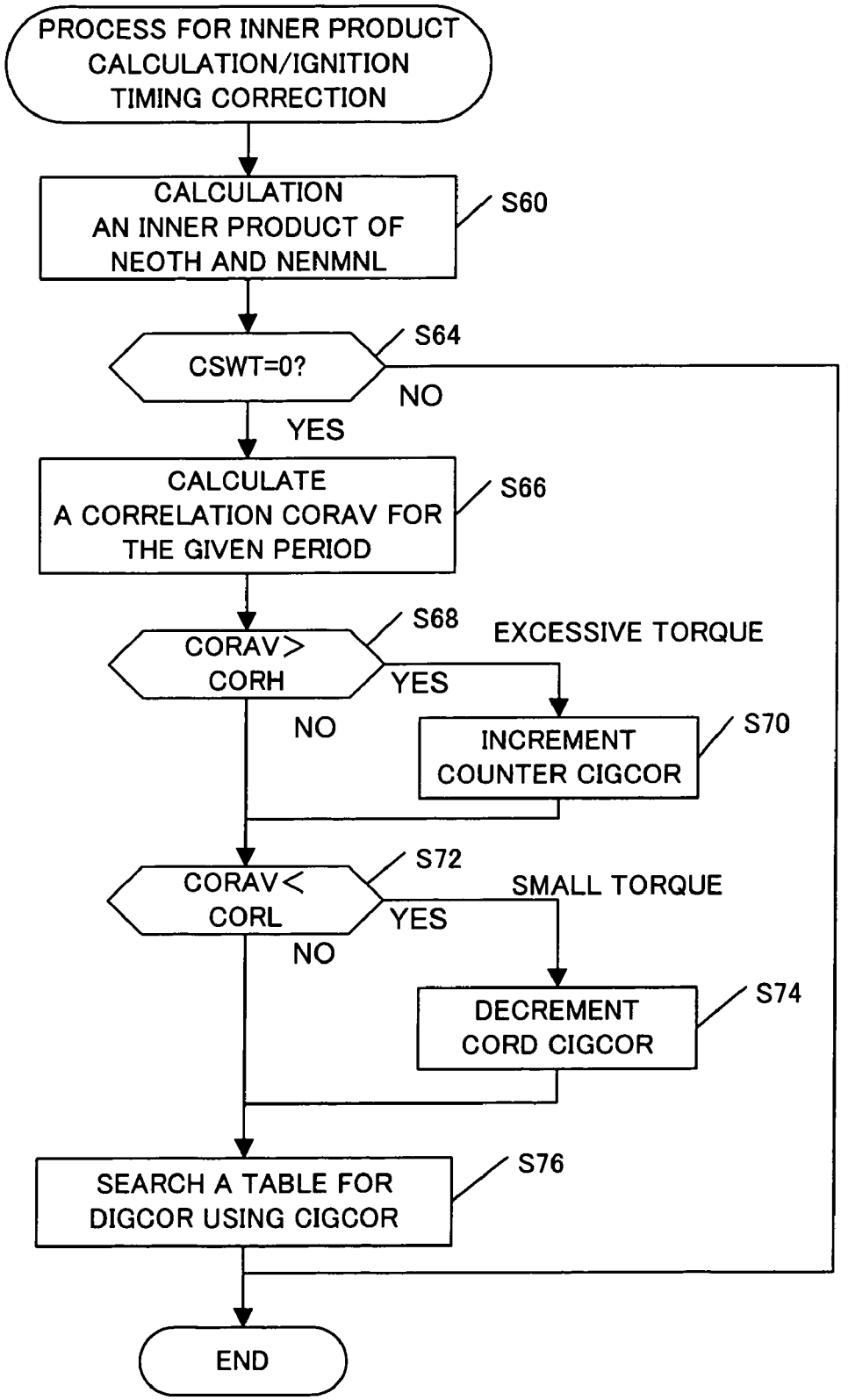
FIG. 6 is a flowchart of a routine for an inner product operation and an ignition timing correction.

FIG. 6 is a flowchart of a routine for the inner product calculation and the ignition timing correction. In this routine, a correlation value CORAV between the normalized NE variation component vector NEOTH and the variation pattern vector NENMNL is calculated by the inner product of the vectors. The calculated correlation is reflected to the ignition timing correction.

First, inner product components NEOTH×NENMNL are computed and stored in the buffers NEINP[b] (b=0 to FREQRICH−1) for the given period (S60).

$$NEINP[b] = NEOTH \times NENMNL \tag{5}$$

Then, a sum of NEINP[0] through NEINP [FREQRICH−1] is obtained as a basic correlation value CORNE.

$$CORNE = \sum_{b=0}^{FRQRICH-1} NEINP[b] \tag{6}$$

Next, in order to validate completion of the summing operation for the given period, the counter CSWT checked to see if it is 0 (S64). When the counter reaches 0, the process proceeds to the next phase because the summation required is completed.

A decimating process for CORNE is performed by using the counter CSWT (for 8 TDCs in the present embodiment) and the result is stored in CORDS. Then, a moving average of CORDS in an arbitrary period CORTAP is obtained as a correlation value CORAV (S66).

$$CORAV = \sum_{i=0}^{CORTAP-1} \frac{CORDS[i]}{CORTAP} \tag{7}$$

The correlation value CORAV represents a correlation between the normalized NE variation signal NEOTH and the NE variation pattern NENMNL. The correlation value CORAV above a predetermined upper limit value CORH (for example, 0.5) indicates that the torque variation in the given period is excessive (S68). In this case, counter CIGCOR is incremented (S70). The correlation value CORAV smaller than a predetermined lower limit value CORL (for example, −0.5) indicates that the torque variation in the predetermined cycle is small (S72). In this case, the counter CIGCOR is decremented (S74). As a matter of course, other values may be used for the threshold values.

Figure 7:
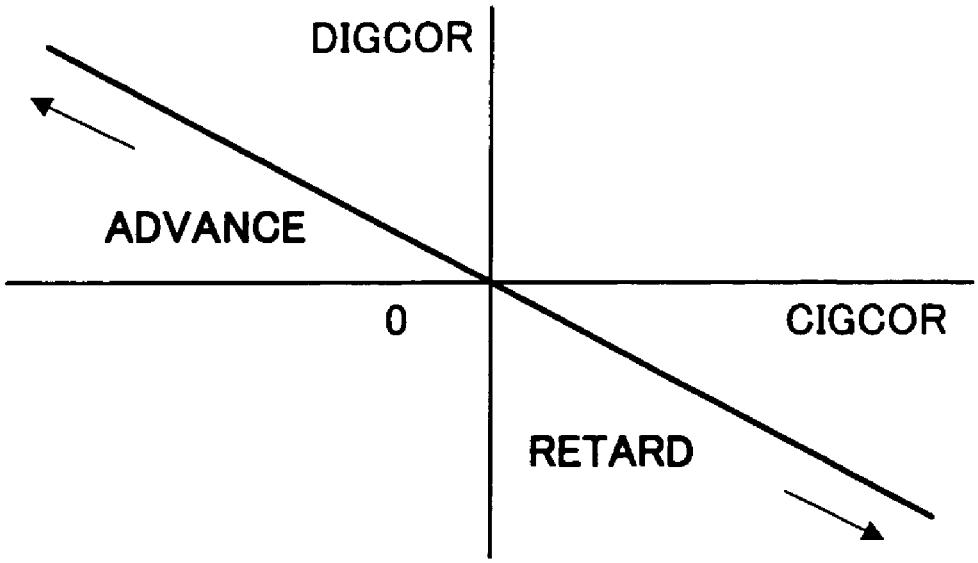
FIG. 7 shows a table to be used for determining an ignition timing correction amount.

An ignition timing correction value DIGCOR is obtained through a table such as shown in FIG. 7, in accordance with the value of the counter CIGCOR (S76). According to the table of FIG. 7, the retard amount increases in proportion to the increase of the counter value CIGCOR and the advance amount increases in proportion to the decrease of the counter value CIGCOR. In other words, by using this counter CIGCOR, ignition timing is retarded when the torque variation during a given period is excessive and is advanced when the torque variation is small.

Based on experiments performed in advance, the table of FIG. 7 can be established to obtain a retard amount that is appropriate for offsetting the increase/decrease of the torque. The obtained ignition timing correction amount DIGCOR is added to the basic ignition timing IGLOGP in the given period and according to this corrected ignition timing, the spark plug 18 of the engine 1 is activated.

Figure 8:
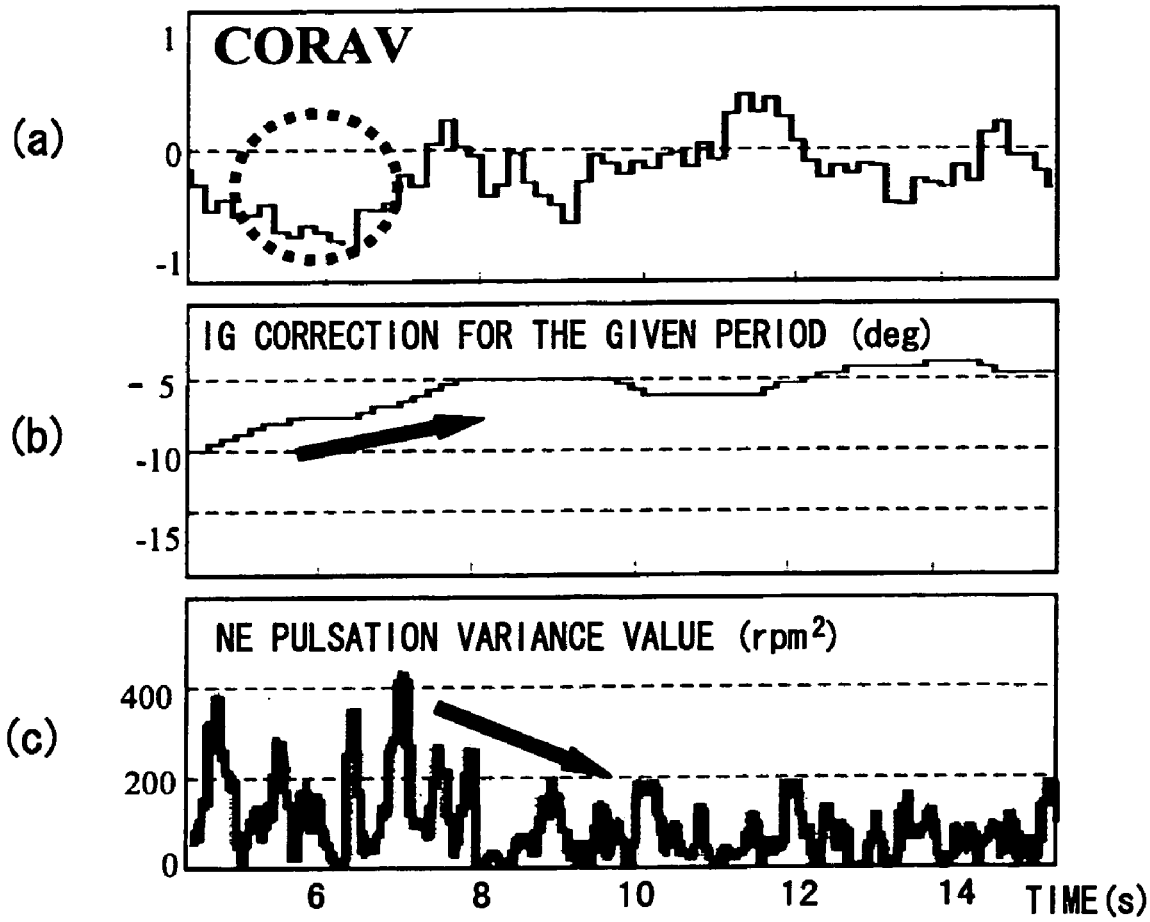
FIG. 8 shows respective movements of (a) a correlation value CORAV for an internal combustion engine (b) an ignition timing correction amount and (c) a variance of vibrations in engine rotational speeds.

FIG. 8 shows respective movements of (a) the correlation value CORAV when the above-described embodiment is applied, (b) the ignition timing correction amount in the given period and (c) the corresponding variance of the vibration in the engine rotational speeds NE. When the CORAV becomes less than the lower limit value CORL as shown by a circle in (a) of FIG. 8 and when the torque in the given period is too small, the ignition timing is advanced as shown by an arrow in (b) of FIG. 8. Accordingly, the torque variation caused by the air-fuel ratio switching is suppressed and the vibration of the engine rotational speed NE is decreased as shown by an arrow in (c) of FIG. 8.

Besides, according to the conventional approaches, the torque variation is detected only by searching a map. However, according to the present invention, the actual torque is detected and the correlation value is calculated in order to determine the ignition timing. Therefore, according to the present invention, it is possible to suppress the torque variation in consideration the deterioration over time or the like.

Although it is described in the above-described embodiment that the switching cycle for the air-fuel ratio causes the torque variation (especially at the catalyst warming-up control time), the present invention may be applied to a method for detecting a general torque variation by changing the variation pattern. It is also possible to use multiple variation patterns and select the most appropriate one depending on the situation.

In another embodiment, it is possible to suppress the torque variation by adjusting such air conditioning device as the throttle valve instead of correcting the ignition timing.

Besides, the present invention can be applied to such vessel-propelling engine as an outboard motor having a vertically extending crankshaft.

According to the present invention, since the magnitude of the torque variation is determined by using the correlation between the variation in the rotations at the air-fuel ratio switching time and the pre-established torque variation pattern, not only the torque variation of the engine can be controlled in real time but also the rotation variation caused by the deterioration over time or the like can be detected.

What is claimed is:

1. A control system for an internal combustion engine, the control system comprising:

a detector for detecting a rotational speed of an internal combustion engine;

a memory for storing a variation pattern of the rotational speed of the engine under the condition of excessive torque; and a controller programmed to;

calculate a variation component of the rotational speed based on the rotational speed detected by the detector, calculate a correlation between the variation component and the variation pattern that is read out from the memory, and determine a torque variation state of the engine based on the calculated correlation.

2. The control system as claimed in claim 1, wherein said controller is further programmed to correct an ignition timing of the engine based on the determination result regarding the torque variation state.

3. The control system as claimed in claim 1, wherein said controller is further programmed to correct an intake air amount of the engine based on the determination result regarding the torque variation state.

4. The control system as claimed in claim 1, wherein the variation component is calculated based on difference between the rotational speed and an average of the rotational speeds.

5. The control system as claimed in claim 1, wherein the variation component is calculated based on difference between the rotational speed and a normalized value for the rotational speed.

6. The control system as claimed in claim 5, wherein the normalized value is calculated by dividing the difference between the rotational speed and the average of the rotational speed by a square root of a product of a variance of the difference and a given period.

7. The control system as claimed claim 6, wherein the correlation is determined based on an inner product of the variation component of the rotational speed and the variation pattern, and wherein the controller is configured to determine that the torque variation of the engine is excessive when the correlation value exceeds a predetermined upper limit value and to determine that the torque variation of the engine is too small when the correlation is less than a predetermined lower limit value.

8. The control system as claimed in claim 7, wherein said controller is further programmed to retard an ignition timing of the engine when the torque variation of the engine is determined to be excessive, and to advance the ignition timing of the engine when the torque variation of the engine is determined to be too small.

9. The control system as claimed in claim 7, wherein the controller is further programmed to decrease an intake air amount of the internal combustion engine when the torque variation of the engine is determined to be excessive, and to increase the intake air amount of the engine when torque variation of the engine is determined to be too small.

10. The control system as claimed in claim 1, wherein the torque variation state is determined when an air-fuel ratio is intermittently switched between lean and rich.

11. The control system as claimed in claim 1, wherein the torque variation state is determined when a catalyst warming-up control is performed upon a catalyst disposed on the downstream side of the engine.

12. A control system for an internal combustion engine, the control system comprising:

means for detecting a rotational speed of an internal combustion engine;

means for storing a variation pattern of the rotational speed of the engine under the condition of excessive torque;

means for calculating a variation component of the rotational speed based on the rotational speed detected by the detector and calculating the correlation between the variation component and the variation pattern that is read out from the memory; and means for determining a torque variation state of the engine based on the calculated correlation.

13. The control system as claimed in claim 12, further comprising means for correcting an ignition timing of the engine based on the determination result regarding the torque variation state.

14. The control system as claimed in claim 12, further comprising means for correcting an intake air amount of the engine based on the determination result regarding the torque variation state.

15. The control system as claimed in claim 12, wherein the variation component is calculated based on difference between the rotational speed and an average of the rotational speeds.

16. The control system as claimed in claim 12, wherein the variation component is calculated based on difference between the rotational speed and a normalized value for the rotational speed.

17. The control system as claimed in claim 16, wherein the normalized value is calculated by dividing the difference between the rotational speed and the average of the rotational speed by a square root of a product of a variance of the difference and a given period.

18. The control system as claimed claim 17, wherein the correlation is determined based on an inner product of the variation component of the rotational speed and the variation pattern, and wherein the controller is configured to determine that the torque variation of the engine is excessive when the correlation value exceeds a predetermined upper limit value and to determine that the torque variation of the engine is too small when the correlation is less than a predetermined lower limit value.

19. A method for determining torque variation of the internal combustion engine, comprising the steps of:

detecting a rotational speed of an internal combustion engine;

storing a variation pattern of the rotational speed of the engine under the condition of excessive torque;

calculating a variation component of the rotational speed based on the rotational speed detected by the detector and calculating the correlation between the variation component and the variation pattern that is read out from the memory; and determining a torque variation state of the engine based on the calculated correlation.

20. The method as claimed in claim 19, further comprising the step of correcting an ignition timing of the engine based on the determination result regarding the torque variation state.

21. The method as claimed in claim 20, further comprising the step of correcting an intake air amount of the engine based on the determination result regarding the torque variation state.

22. The method as claimed in claim 19, wherein the variation component is calculated based on difference between the rotational speed and an average of the rotational speeds.

23. The method as claimed in claim 19, wherein the variation component is calculated based on difference between the rotational speed and a normalized value for the rotational speed.

24. The method as claimed in claim 23, wherein the normalized value is calculated by dividing the difference between the rotational speed and the average of the rotational speed by a square root of a product of a variance of the difference and a given period.

25. The method as claimed claim 24, wherein the correlation is determined based on an inner product of the variation component of the rotational speed and the variation pattern, and wherein the controller is configured to determine that the torque variation of the engine is excessive when the correlation value exceeds a predetermined upper limit value and to determine that the torque variation of the engine is too small when the correlation is less than a predetermined lower limit value.

26. The method as claimed in claim 25, further comprising the steps of retarding an ignition timing of the engine when the torque variation of the engine is determined to be excessive, and of advancing the ignition timing of the engine when the torque variation of the engine is determined to be too small.

27. The method as claimed in claim 26, further comprising the steps of decreasing an intake air amount of the internal combustion engine when the torque variation of the engine is determined to be excessive, and of increasing the intake air amount of the engine when torque variation of the engine is determined to be too small.

28. The method as claimed in claim 19, wherein the torque variation state is determined when an air-fuel ratio is intermittently switched between lean and rich.

29. The method as claimed in claim 19, wherein the torque variation state is determined when a catalyst warming-up control is performed upon a catalyst disposed on the downstream side of the engine.

* * * * *